US007131164B2

(12) United States Patent
Uratani et al.

(10) Patent No.: US 7,131,164 B2
(45) Date of Patent: Nov. 7, 2006

(54) VACUUM CLEANER AND SUCTION NOZZLE EMPLOYED THEREIN

(75) Inventors: Hiroyuki Uratani, Shiga (JP); Masakuni Soejima, Shiga (JP); Koichi Fujita, Shiga (JP); Masaki Shibuya, Shiga (JP); Hidetoshi Imai, Shiga (JP); Masaki Takahashi, Shiga (JP); Masaichi Fukushima, Shiga (JP); Hiroyuki Senoo, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 517 days.

(21) Appl. No.: 10/443,036

(22) Filed: May 22, 2003

(65) Prior Publication Data

US 2003/0217431 A1 Nov. 27, 2003

(30) Foreign Application Priority Data

May 22, 2002 (JP) ..... 2002-147406
May 23, 2002 (JP) ..... 2002-148758
Mar. 19, 2003 (JP) ..... 2003-075692

(51) Int. Cl.
*A47L 9/02* (2006.01)
*A47L 9/24* (2006.01)

(52) U.S. Cl. ..... 15/328; 15/331; 15/377

(58) Field of Classification Search ..... 15/328, 15/331, 334, 415.1, 393, 398, 319, 339, 377, 15/327.1
See application file for complete search history.

(56) References Cited

U.S. PATENT DOCUMENTS

| | | | | |
|---|---|---|---|---|
| 4,700,428 | A | 10/1987 | Hetherington | |
| 4,787,117 | A * | 11/1988 | Westergren | 15/339 |
| 4,817,234 | A * | 4/1989 | Greulich | 15/339 |
| 5,023,973 | A * | 6/1991 | Tsuchida et al. | 15/319 |
| 5,301,385 | A * | 4/1994 | Abe et al. | 15/319 |
| 6,255,792 | B1 * | 7/2001 | Grasso et al. | 318/508 |
| 6,481,043 | B1 * | 11/2002 | Anderson et al. | 15/246.2 |
| 6,763,549 | B1 * | 7/2004 | Peters | 15/374 |
| 6,839,934 | B1 * | 1/2005 | Houghton et al. | 15/329 |
| 2001/0037536 | A1 * | 11/2001 | Kim | 15/361 |

FOREIGN PATENT DOCUMENTS

| | | | |
|---|---|---|---|
| JP | 51043863 | | 4/1976 |
| JP | 9-10150 | * | 1/1997 |

* cited by examiner

*Primary Examiner*—Terrence R. Till
(74) *Attorney, Agent, or Firm*—Bacon & Thomas, PLLC

(57) ABSTRACT

A suction nozzle for use in a vacuum cleaner includes a floor nozzle and a mini nozzle having a suction head, a rotatable joint, and joint, to be detachably secured in the floor nozzle. Either of the suction head and the rotatable joint or the rotatable joint and the joint is vertically joined and the other rotatably joined. Moreover, the suction head is unrotatably secured onto the floor nozzle, and forms an air communication with the floor nozzle.

22 Claims, 20 Drawing Sheets

VACUUM CLEANER AND SUCTION NOZZLE EMPLOYED THEREIN

FIELD OF THE INVENTION

The present invention relates to a suction nozzle employed in an electric vacuum cleaner; and, more particularly, to a floor nozzle incorporating a compact nozzle detachably attached thereto.

BACKGROUND OF THE INVENTION

FIG. 21 represents an exemplary canister type vacuum cleaner including an extension tube 102 detachably attached to a suction nozzle 101 in a front distal end thereof and further coupled to a handle 103 and a hose 104 which extends from the handle 103 is connected with a main body 106 via a joint 105. Such an electric vacuum cleaner is capable of efficiently cleaning the floor with the wide surfaced floor nozzle 101, however, cleaning a surface that is smaller than the floor nozzle 101, e.g., when cleaning the stairs, creates a problem of using the floor nozzle 101. In general, such surfaces are cleaned with crevice nozzles and brush nozzles that are equipped with the electric vacuum cleaner as supplements to the floor nozzle 101 by removing the extension tube 102 from the handle 103 and engaging the supplement nozzle with the handle 103.

However, the exchange of the suction heads is a great inconvenience to a user. Furthermore, due to rollers provided on the floor nozzle 101 for facilitating transportability thereof and disengaged extension tube 102 attached thereto, the disengaged extension tube 102 and the floor nozzle 101 are prevented from being stationary against a wall, thus a problem of placement thereof rises while being disengaged. A floor nozzle 101 that can easily be adaptively exchanged with a compatt nozzle in a narrow vacuuming space can greatly enhance the vacuuming process. Such effort is realized in the prior art, as illustrated in Japanese Patent Laid-Open Publication No. 2001-314358.

Special features of such an electric vacuum cleaner are in a suction nozzle thereof. As illustrated in FIG. 22, a front distal end of an extension tube 213 is connected with a hollow brush nozzle 250 via a ball join 240 that enables a rotation in a vertical direction and a direction of rotation, wherein the brush nozzle 250 is detachably installed with an opening 211*a* that is communicated with a suction inlet of the floor nozzle 210. While the brush nozzle 250 is engaged with the floor nozzle 210 that is attached to the distal end of the extension tube 213, an air passage is formed through the hollow brush nozzle 250 and the floor nozzle 210, thereby enabling cleaning of the floor with the floor nozzle 210. The brush nozzle 250 can be disengaged from the floor nozzle 210 by stepping on a release 320. Such a configuration enables a user to manipulate settings of the brush nozzle 250 with the floor nozzle 210 without having to bend down, facilitating converting from cleaning the floor to cleaning the steps and narrow cleaning surfaces.

However, a height of the floor nozzle 210 of the conventional vacuum cleaner described above is high enough to be limited for usage thereof in a cleaning surface that has a low height clearance, consequently restricting the cleaning surfaces to be cleaned by the floor nozzle 210.

Furthermore, there is a great difficulty to reorient the floor nozzle 210 to a desired direction by rotating the extension tube 213, since the handle to operate the floor nozzle 210 is connected with the extension tube 213 which is connected at an incline with the ball joint 240 that is vertically placed on the floor nozzle 210, consequently hindering an efficient cleaning using the floor nozzle 210.

Moreover, since the brush nozzle 250 is connected with the extension tube 213 via the ball joint 240 that is vertically rotatable and also rotatable in the direction of rotation, when the brush nozzle 250 is disengaged from the floor nozzle 210 for cleaning, an instability of an angle at which the brush nozzles 250 rests creates a difficulty in cleaning.

SUMMARY OF THE INVENTION

It is, therefore, a primary object of the present invention to provide a floor nozzle and a mini nozzle for use in an electric vacuum cleaner capable of facilitating detachability thereof, thereby adding greater convenience.

In accordance with a preferred embodiment of the present invention, there is provided a suction nozzle for use in an electric vacuum cleaner, including: a floor nozzle; and a mini nozzle detachably secured to the floor nozzle, the mini nozzle including a suction head, a joint, and an extension tube, wherein one of either the suction head and the joint or the joint and the extension tube is coupled allowing a vertical motion and the other is rotatably coupled, and wherein the suction head is unrotatably secured onto the floor nozzle while forming an air communication with the floor nozzle.

In accordance with another preferred embodiment of the present invention, there is provided a suction nozzle for use in an electric vacuum cleaner, including: a floor nozzle having an elongated suction inlet and a drive portion protruding from approximately the center of the elongated suction inlet toward the rear; and a mini nozzle detachably secured to the floor nozzle, wherein the mini nozzle long in the longitudinal direction is detachably aligned with a recess provided along the suction inlet and the drive portion of the floor nozzle, while forming an air communication with the floor nozzle.

In accordance with still another preferred embodiment of the present invention, there is provided a suction nozzle for use in an electric vacuum cleaner, including: an electric blower for creating a suction; a floor nozzle communicated with the electric blower, for suctioning dirt on a surface to be cleaned; a mini nozzle detachably secured on the floor nozzle for suctioning dirt on the surface to be cleaned; a sensing means for detecting whether or not the mini nozzle is engaged in the floor nozzle; and a control means for controlling the power consumption of the electric blower, wherein the control means controls the power consumption of the electric blower according to the output of the sensing means.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

A first preferred embodiment will now be described with accompanying drawings. The preferred embodiments to be shown below are particular examples of the present invention and do not limit the technical scope of the present invention.

Figure 1:
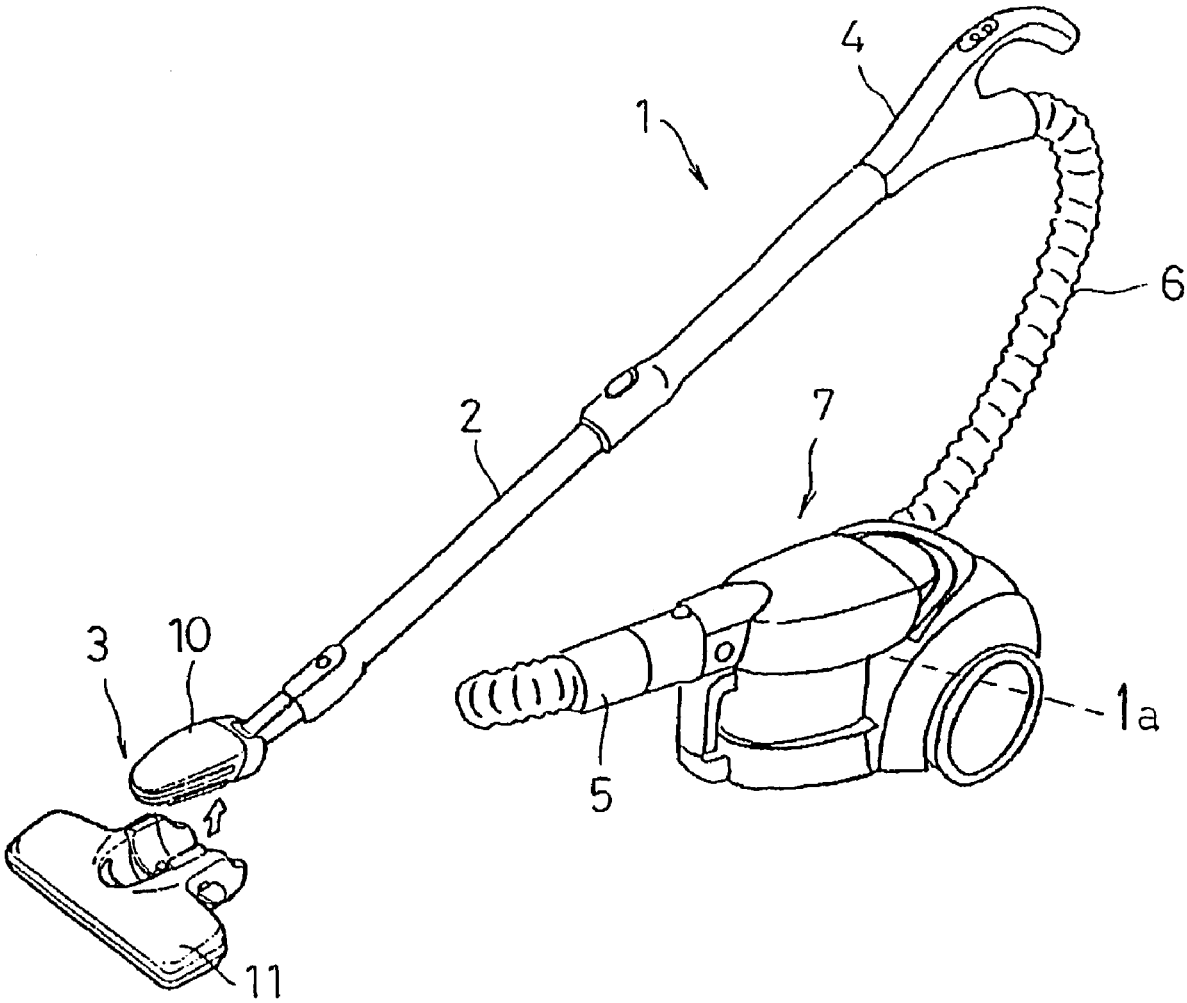
FIG. 1 is a perspective view of a vacuum cleaner in accordance with a first preferred embodiment of the present invention.

As illustrated in FIG. 1, the preferred embodiment pertains to a canister type electric vacuum cleaner 1 and a suction nozzle 3 serving as a suction inlet. The electric vacuum cleaner 1 is configured as shown below. There is detachably provided the suction nozzle 3 at a distal end portion of an extension tube 2 coupled with a handle (control unit) 4. A hose 6 coupled with the handle 4 is connected to a main body 7 of the electric vacuum cleaner via a hose joint 5. The main body 7 incorporates an electric blower 1*a* therein.

Figure 2A:
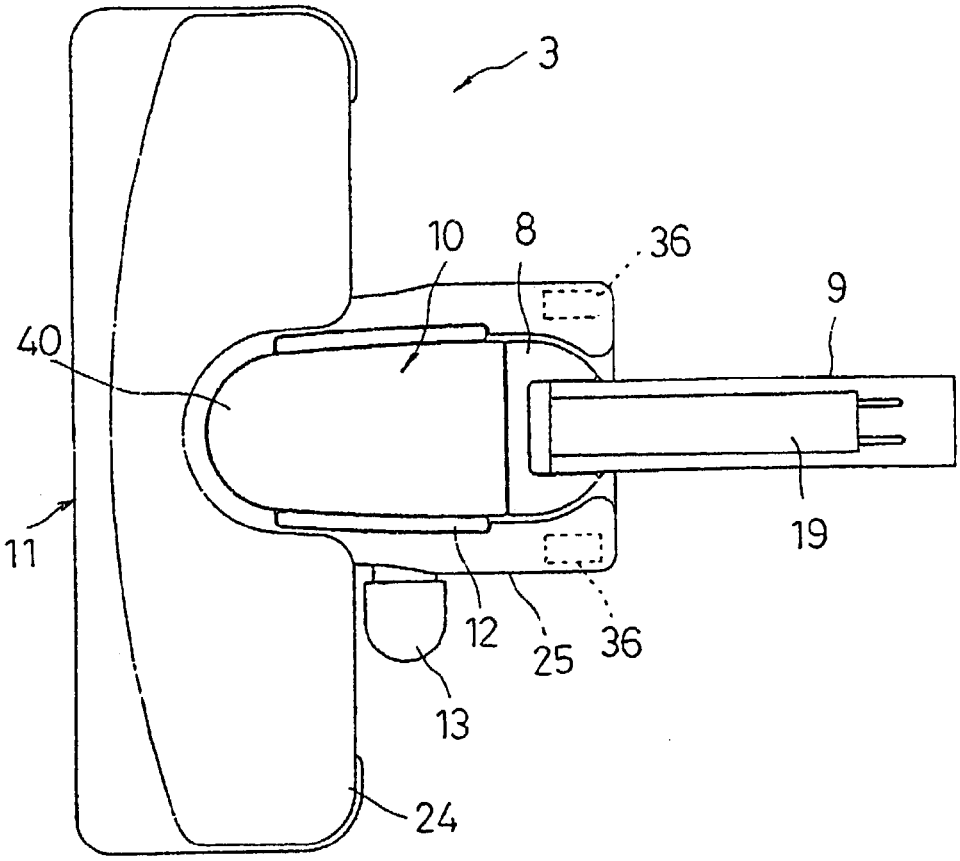
FIGS. 2A and 2B describe a plan view and a side elevational view of a suction nozzle of the vacuum cleaner, respectively.
Figure 2B:
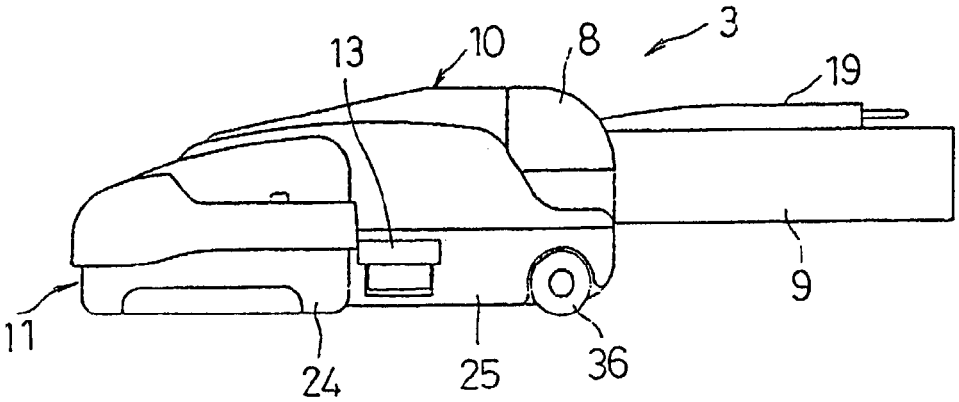

The suction nozzle 3 as illustrated in FIGS. 2A and 2B, includes a floor nozzle 11 and a mini nozzle 10 to be detachably secured onto the floor nozzle 11. The mini nozzle 10 incorporates a joint 9 connected with a suction head 40 via a rotatable joint (means for rotatably joining) 8, to be coupled with the extension tube 2. The mini nozzle 10 detachably secured onto the floor nozzle 11 can be disengaged therefrom by stepping on a release lever 13 provided thereon, thereby releasing the mini nozzle 10 from the supporting recess 12. A user can utilize the disengaged mini nozzle 10 to clean narrow spaces. Moreover, the mini nozzle 10 can be placed on the supporting recess 12 and gently pressed to be engaged with the floor nozzle 11, which can be used to efficiently carry out vacuuming of the floor.

Figure 3A:
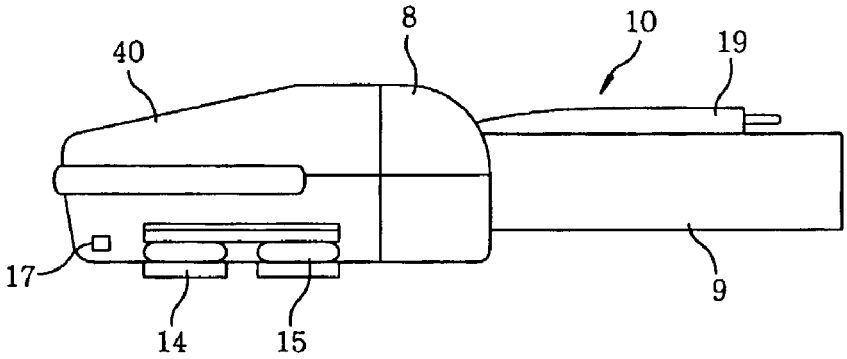
FIGS. 3A, 3B, and 3C show a side elevational view, a bottom view, and a front view of a mini nozzle, respectively.
Figure 3B:
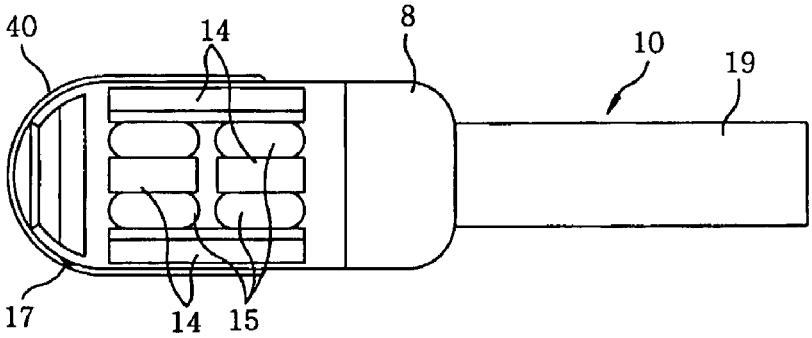
Figure 3C:
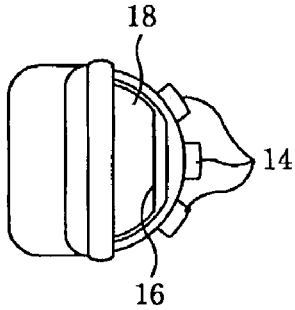
Figure 4:
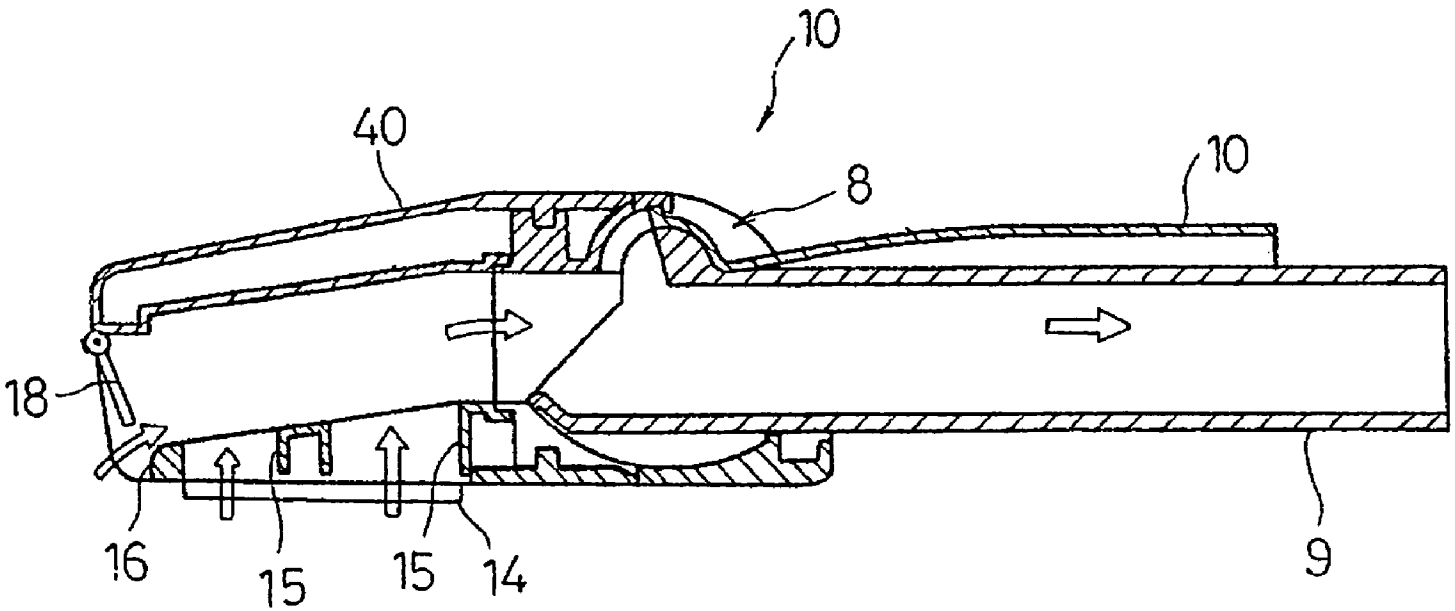
FIG. 4 offers a cross sectional view of the mini nozzle.

The mini nozzle 10 as shown in FIGS. 3A, 3B, 3C is long in the longitudinal direction and a bottom surface to be engaged with the floor nozzle 11 is in a shape of an arc. Near the contact points on the arc in the direction of the axis of the arc cleaning element 14 is provided thereon, wherein on both sides thereof, a bottom suction inlet 15 is provided and cleaning element is provided on respective surfaces. Furthermore, an end opening 16, which communicates with the suction inlet 23 of the floor nozzle 11, as will be described below. While the mini nozzle 10 is disengaged from the floor nozzle 11, the end opening 16 biased with a spring is closed, only partially leaving the bottom thereof open by a cover 18, as illustrated in FIG. 4. The reference numeral 17 designates a pair of feed contact points for forming feed contact points with a motor 21 for supplying rotation to the rotational brush provided in the floor nozzle 11, which is wired from the main body 7 through the hose 6, handle 4, and extension tube 2, to be wired with the distal end of the extension tube 2. When the mini nozzle 10 is connected with the extension tube 2 through the joint 9, a power feed portion 19 provided in the joint 9 is electrically wired to the end wire of the extension tube 2, the mini nozzle 10 is wired with the power feed portion 19 and thus wired with the feed contact point 17.

The cleaning element 14 has napped fibers on a sheet. By utilizing such cleaning element 14 to cover both sides of the bottom suction inlet 15, the suctioning force in the bottom suction inlet 15 is improved. Further, according to the motion of the mini nozzle 10, the dirt in a recess portion is collected toward the bottom suction inlet 15, thereby cleaning the surface to be cleaned and at the same time serving as a bumper, preventing damages to furniture or the surface to be cleaned. The cleaning element 14 is preferably chosen for the mini nozzle 10, however, other material such as felt can be elected.

Moreover, the bottom suction inlet 15 formed on the bottom surface of the mini nozzle 10 is in two rows, however may be formed in a single row near the contract point portions of the arc and placing cleaning element 14 on both sides.

Figure 5:
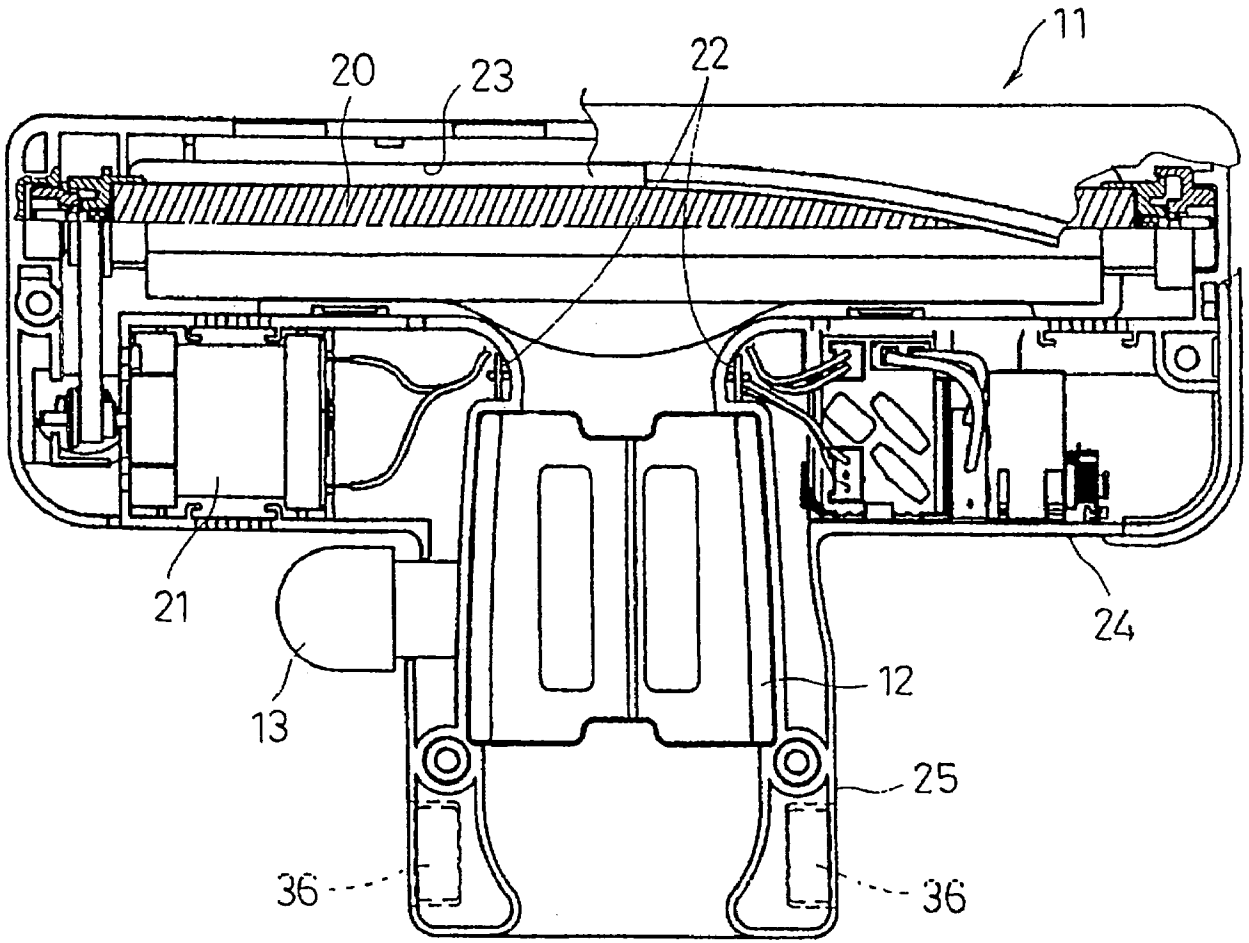
FIG. 5 is a plan view illustrating an internal configuration of a floor nozzle.

The floor nozzle 11 as illustrated in FIG. 5 is of a power nozzle. A rotation brush 20 including a brush and a rubber blade attached to an axle is connected with a motor 21 by a belt 21*a* for providing rotation thereto, which serves to collect dirt from carpets. A power feed for the motor 21 is placed on the mini nozzle 10. A pair of power feed contact points 17 of the mini nozzle 10 slidably contacts a pair of power receiving contact points 22 located on the floor nozzle 11.

Figure 6:
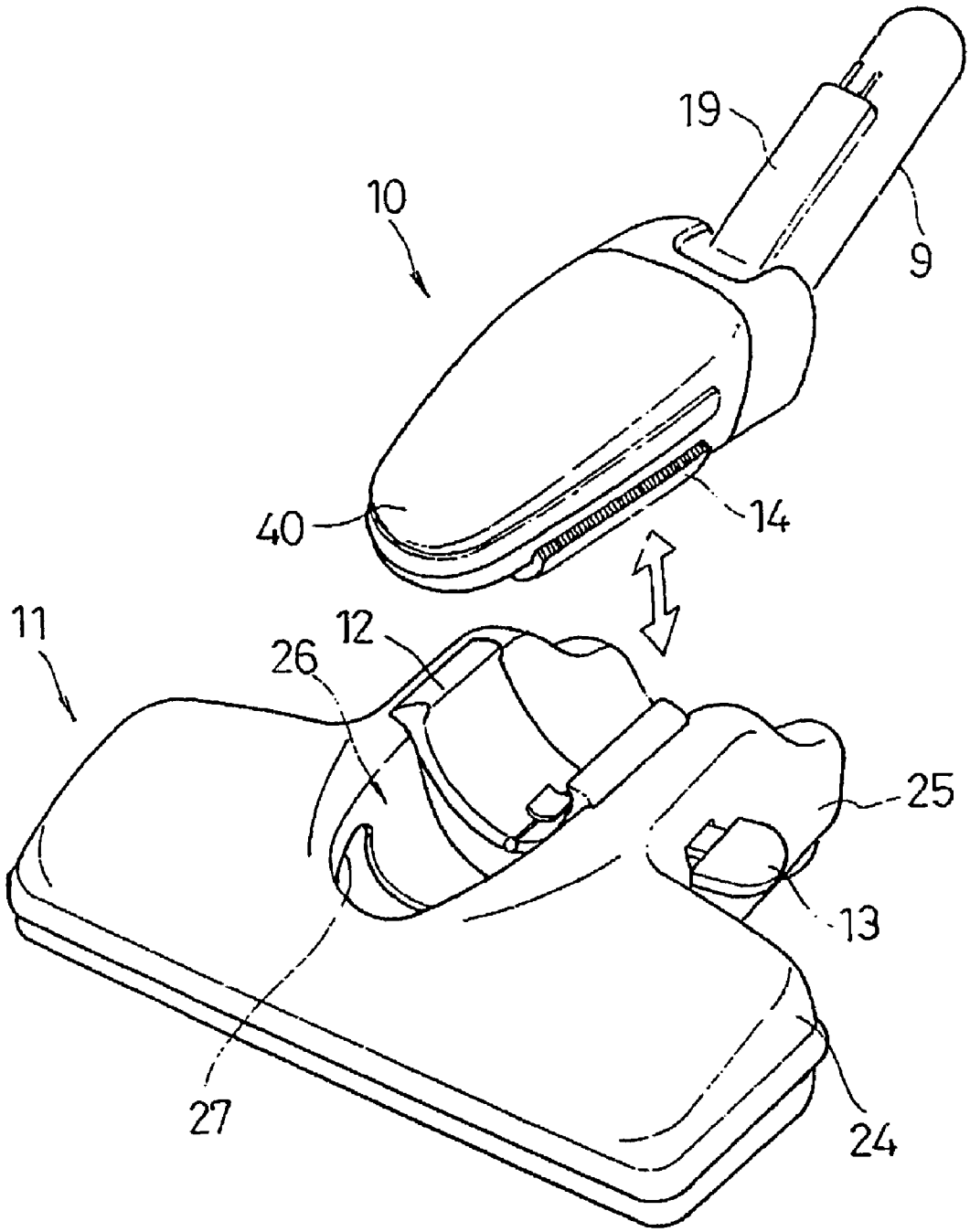
FIG. 6 provides a perspective view illustrating engaging or disengaging the mini nozzle to or from the floor nozzle.

The floor nozzle 11 includes a suction member 24 incorporating a wide suction inlet 23 hosting the rotational brush 20. A drive portion 25 is formed from about the center of the suction inlet 23 and protruding toward the rear, forming a T-shape from a plan view. As illustrated in FIG. 6, a recess 26 for hosting therein the mini nozzle 10 is provided along a top portion of an end portion of the drive portion 25 and the suction member 24. Upon placement of the mini nozzle 10 in the recess 26, the cover 18 of the end opening 16 is opened, to thereby form an air communication between an end portion of the end opening 16 and air passage inlet 27, further forming an air communication with the main body 7.

Figure 7:
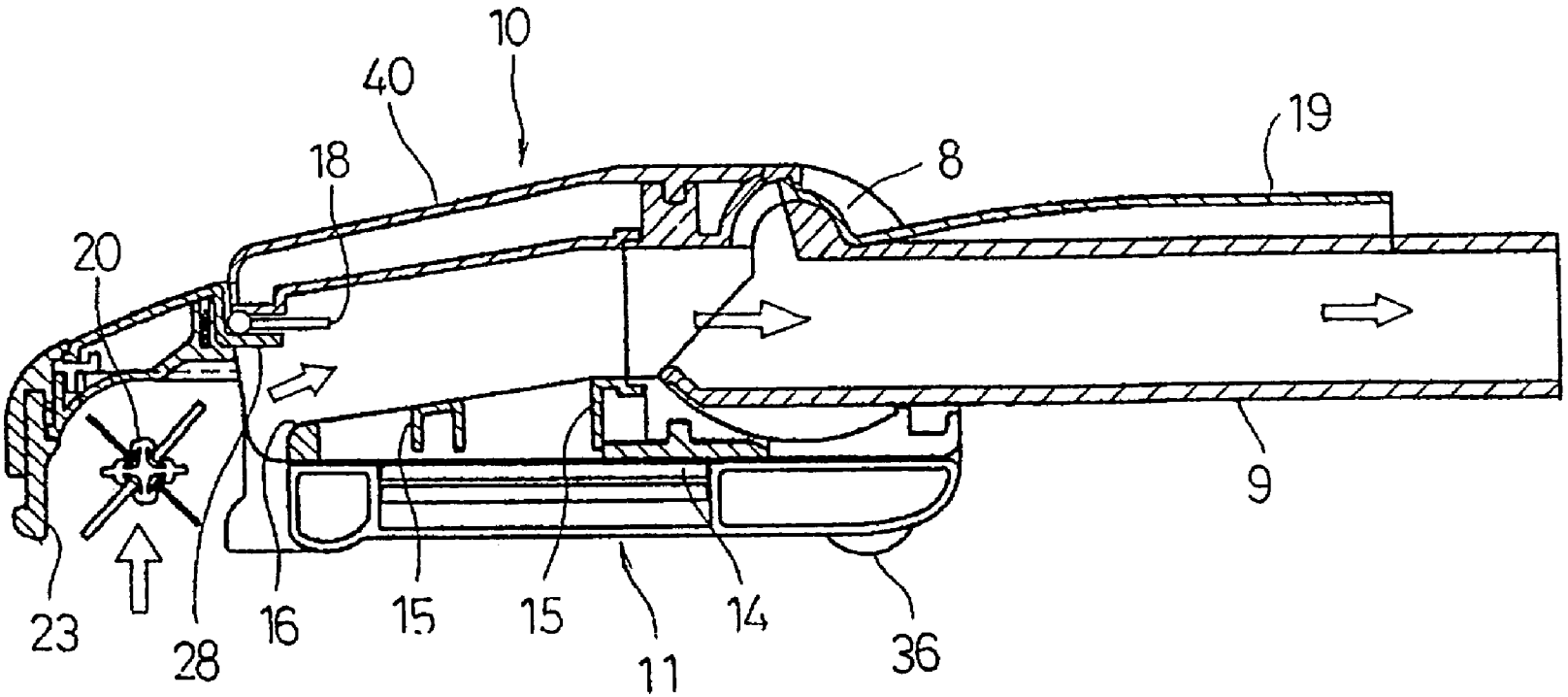
FIG. 7 presents a cross sectional view of the mini nozzle engaged in the floor nozzle.

FIG. 7 illustrates cross sectional view of the mini nozzle 10 engaged with the floor nozzle 11. Upon engaging the mini nozzle 10 onto the floor nozzle 11, an open/close control rib 28 (a means for opening and closing the suction inlet of the end portion), which protrudes from a front region of the recess 26 toward the rear thereof, rotates the cover 18 that partially closes by a spring the end opening 16 of the mini nozzle 10; and due to the resistance of the spring, the cover 18 and the end opening 16 are completely opened, to thereby form an air communication from a suction inlet 23 through the joint 9. Moreover, the bottom suction inlet 15 of the mini nozzle 10 is blocked by the bottom surface of the recess 26, accordingly while the mini nozzle 10 is engaged with the floor nozzle 11, the suction is concentrated only at the suction inlet 23, and thus the suction force of the floor nozzle 11 is not compromised by the engaging of the mini nozzle 10.

As illustrated in FIG. 6, the recess 26 is provided with a depth substantially equivalent to a height of the mini nozzle 10, such that when the mini nozzle 10 is placed in the recess 26, the mini nozzle is flatly integrated into the floor nozzle 11 with minor protrusion of the mini nozzle 10 on the top surface of the floor nozzle 11, as illustrated in FIGS. 2B and 7. Moreover, the height of the floor nozzle 11 is reduced by using small radius wheels 36 on both sides of the recess 26 as shown in FIG. 2.

The mini nozzle 10 can be released from the floor nozzle 11 by pressing down (stepping) on a release lever 13. As illustrated in FIG. 4, the cover 18 closes the end opening 16 located thereon by the spring, since the open/close control rib 28 (a means for opening and closing the cover 18) no longer exerts force thereto. A vertical dimension of the cover 18 is established to be smaller than the height of the end opening 16, and thus leaving a clearance in the bottom portion of the end opening 16, and partially closing the end opening 16. Moreover, since the bottom suction inlet 15 is opened, a lower portion of the end opening 16 and a plurality of the bottom suction inlets 15 form an air communication through the joint 9, to thereby enable dust collection by the mini nozzle 10.

A mechanism of engaging and disengaging of the mini nozzle 10 with/from the floor nozzle 11 will hereinafter be explained with reference to FIGS. 8 and 9.

Figure 8:
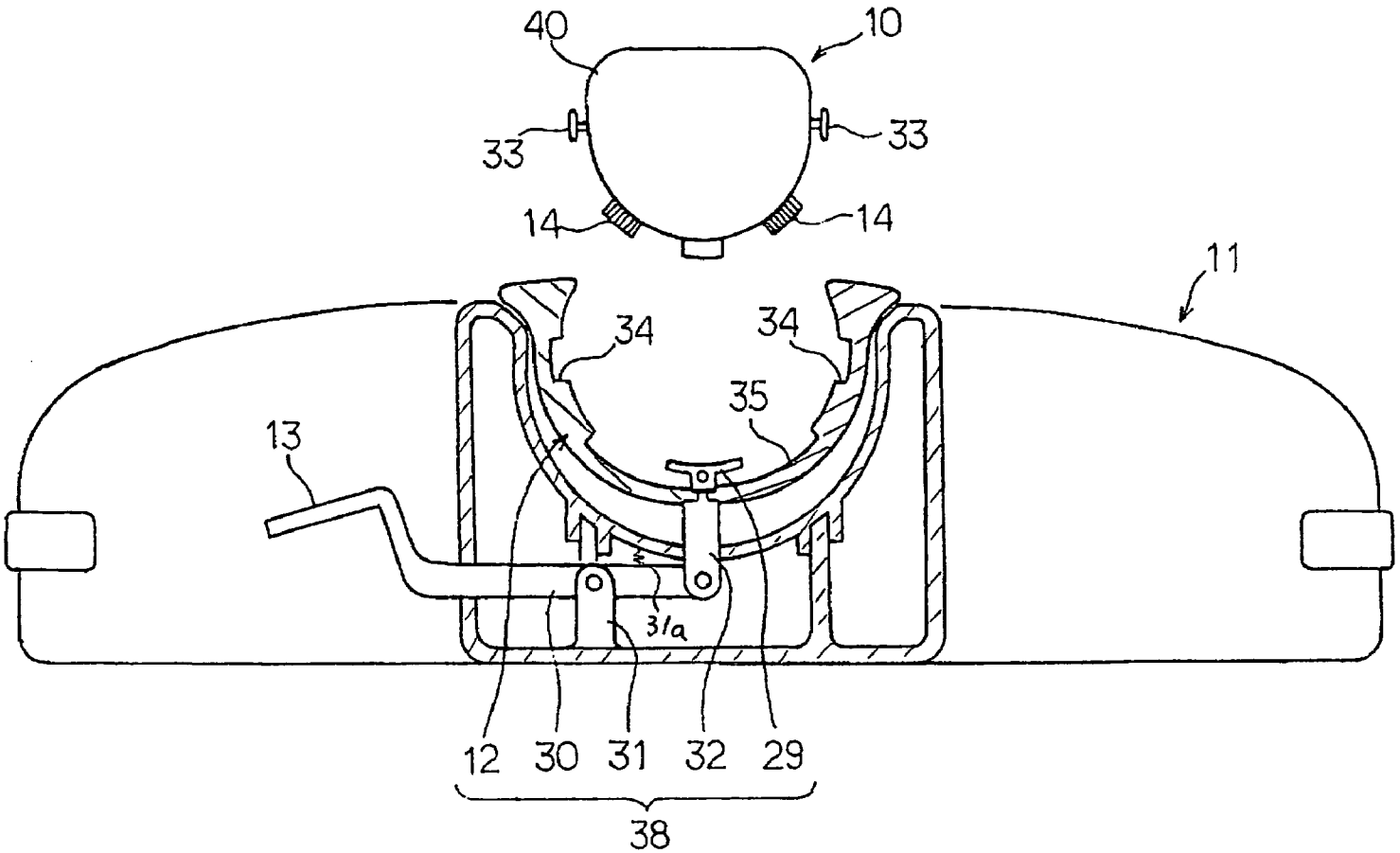
FIG. 8 depicts a floor nozzle disengaged from the floor nozzle.
Figure 9:
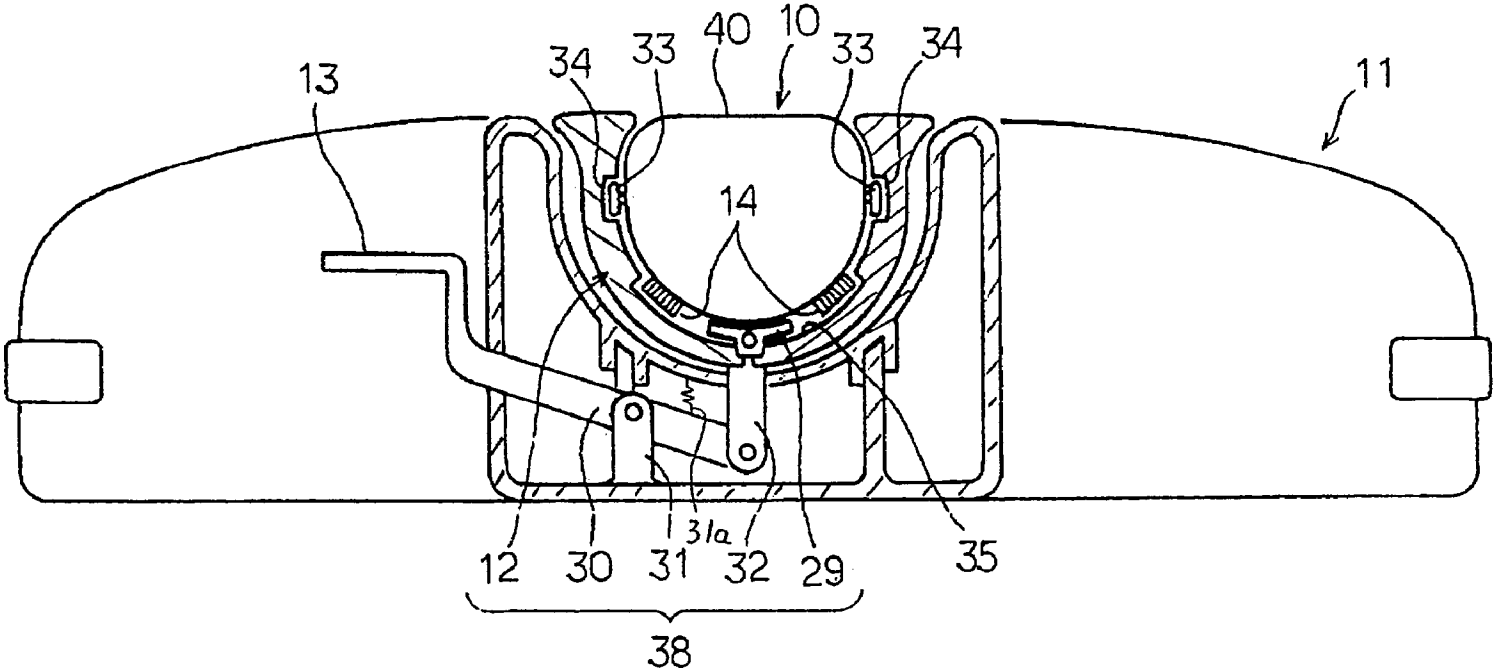
FIG. 9 represents a floor nozzle engaged in the floor nozzle.

Referring to FIGS. 8 and 9, there is provided a support 12 (a means for disengaging and engaging the mini nozzle) in the recess 26 provided in the floor nozzle 11 according to a cross section thereof. The support 12 is attached at the left and the right of the hinge portion in approximately the center thereof, such that a release status as shown in FIG. 8 and a secured status as shown in FIG. 9 can adaptively be controlled. More specifically, during the release status as shown in FIG. 8, the mini nozzle 10 can be disengaged by pressing down on the release lever 13; and during the secured status as shown in FIG. 9, the mini nozzle 10 can be engaged with the floor nozzle 11 by inserting the mini nozzle 10 into the support 12.

During the release status as shown in FIG. 8, the support 12 is unfolded at the left and the right of the hinge portion in approximately the center thereof. Upon inserting the mini nozzle 10 in the support 12, a pressure member 29 placed in an approximately the center of the hinge portion is lowered and exerts force between cleaning element 14 partitioned in front and rear of a top portion of the side of the arc of the mini nozzle 10, such that the support 12 is lowered to the bottom surface of the recess 26 and as illustrated in FIG. 9 the suction head 40 portion of the mini nozzle 10 is surrounded and secured thereby. While the pressure member 29 is lowered, a moving member 32 pushes down on one of the ends of a rod 30 axially supporting a supporting member 31 connected thereto. Accordingly, a release lever 13 placed on the other end of the rod 30 is raised as illustrated in FIG. 9. A disengaging and engaging unit 38 of the mini nozzle 10 includes the pressure member 29, the rod 30, the supporting member 31, moving member 32, and the support 12. The supporting member 31 serves as a fulcrum for the rod 30 and the rod 31 is downwardly biased with an elastic spring 31*a*, to thereby support the mini nozzle 10.

There are provided outwardly biased pins 33 on both sides of the mini nozzle 10 in order to effectively secure the mini nozzle 10 onto the support 12 and corresponding recesses 34 in the support 12, so that when the mini nozzle 10 is inserted into the support 12, the pins 33 are secured in the recesses 34, and thus providing a more stable support of the mini nozzle 10 in the floor nozzle 11. Furthermore, there is provided a recess 35 for hosting the cleaning element 14 on the mini nozzle 10, as to prevent the cleaning element 14 from interfering with the securing of the mini nozzle 10.

The release lever 13 in an up position is pressed down, in order to release the mini nozzle 10 from the floor nozzle 11 in a secured status as illustrated in FIG. 9, at which time the rod 30 is rotated about the supporting member 31 and raises the hinge portion of the support 12 by the moving member 32. Thus, the support 12 is opened and the mini nozzle 10 is raised due to the pressure member 29, thereby disengaging the mini nozzle 10 from the floor nozzle 11.

The rotatable joint 8 which is connected rotatably in a vertical and horizontal direction is provided between the suction head 40 and the joint 9 in the mini nozzle 10 as described. And as illustrated in FIGS. 2 and 7, when the mini nozzle 10 is engaged with the floor nozzle 11, the rotatable joint 8 engages in a vertical and horizontal motion corresponding to the motion of the handle 4 connected with the joint 9 via the extension tube 2, that is when the handle 4 is manipulated so that floor nozzle 11 changes position in a horizontal direction, due to the rotatable joint 8 horizontally rotatable provided in the back of the floor nozzle 11, the rotational motion is applied to the floor nozzle 11, and consequently enabling a change of direction for the floor nozzle 11.

Figure 10A:
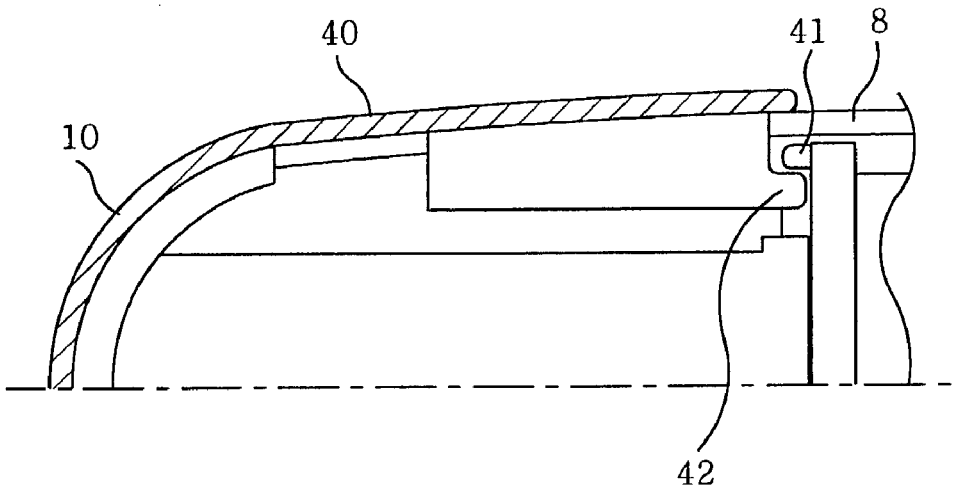
FIGS. 10A and 10B set forth a partial cross sectional view of a suction head in a rotatable status and a partial cross sectional view of a the suction head in a locked status preventing rotation thereof, respectively.
Figure 10B:
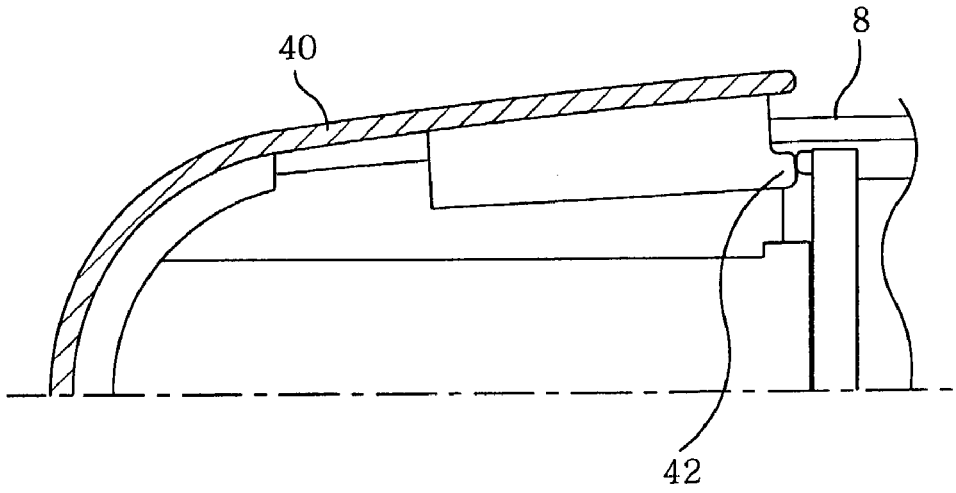

When using the mini nozzle 10 disengaged from the floor nozzle 11, there is a great difficulty in manipulating the mini nozzle in a horizontal direction. Accordingly, there is a need for a locking mechanism, which prevents the rotatable joint 8 from engaging in a horizontal rotation. Such a locking mechanism as illustrate in FIGS. 10A and 10B, there is provided a lock 42 which pops in and out in the rotational path of the rotational motion rib 41 of the rotatable joint 8 of the mini nozzle 10, such that when the mini nozzle 10 is engaged with the floor nozzle 11, the lock 42 is removed from the rotational path by the support 12, however, when the mini nozzle 10 is disengaged from the floor nozzle 11, the lock protrudes into the rotational path.

When the mini nozzle 10 is disengaged from the floor nozzle 11, the lock 42 protrudes into the rotational path of the rotational motion rib 41 of the rotational joint 8 and locks the rotational motion. Consequently, only a vertical motion is permitted between the rotatable joint 8 and the joint 9, thereby facilitating the usage of the vacuum, since the surface of the suction head 40 which faces the surface to be cleaned, of the mini nozzle 10 rotates in a horizontal direction.

As another alternative to such a locking mechanism, a spring biased stopper may be installed (not illustrated), such that when the mini nozzle 10 is engaged with the floor nozzle 11, an overriding mechanism provided on the floor nozzle 11 resisting the spring force removes the stopper from restricting the rotation, and thus when the mini nozzle 10 is placed in the floor nozzle 11, the stopper does not restrict the rotation, enabling a vertical and horizontal rotation of the floor nozzle 11, while restricting such rotation when the mini nozzle 10 is disengaged from the floor nozzle 11.

In an electric vacuum cleaner 1 employing such a configuration of the suction inlet 3 described above, when the mini nozzle 10 is engaged with the floor nozzle 11, the wide floor nozzle 11 can effectively perform vacuum cleaning on a surface to be cleaned as the conventional vacuum cleaner. In a case of a narrow space, e.g., stairway, that is inaccessible with the floor nozzle 11, the released lever 13 can be stepped on, without the user having to bend down, to disengage the mini nozzle 10 from the floor nozzle 11, to thereby enable a vacuum cleaning with the mini nozzle 10. The user is relieved from having to exchange the end nozzle. Moreover, the floor nozzle 11 which is disengaged from the mini nozzle 10 is placed on the surface to be cleaned. Accordingly, the user may simply insert the mini nozzle 10 into the floor nozzle 11 to swiftly switch on a surface to be cleaned.

Figure 11A:
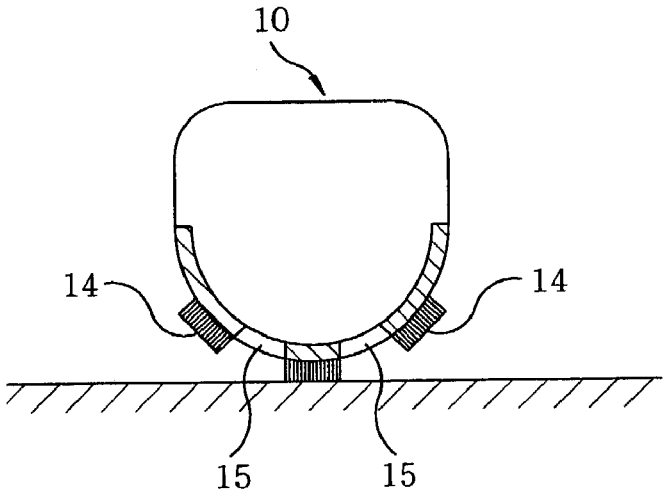
FIGS. 11A and 11B describe a mini nozzle performing suction on a flat surface to be cleaned and a cornered surface to be cleaned, respectively.
Figure 11B:
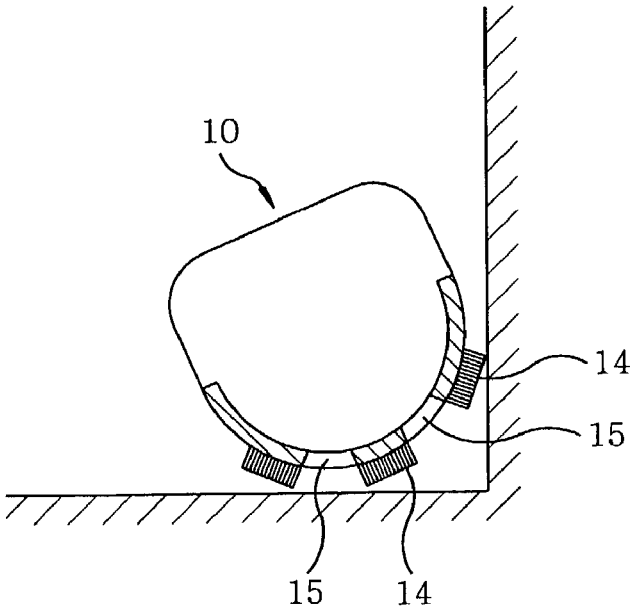

When the mini nozzle 10 is disengaged with the floor nozzle 11, since the bottom suction inlet 15 is formed of a shape of an arc, as illustrated in FIG. 11, the mini nozzle 10 can be at any discretionary angle. In particular, as shown in FIG. 11B, the dust in corners formed by walls or furniture can be collected by the suction of the bottom suction inlet 15. Moreover, the end opening 16 of the mini nozzle 10 as described is partially closed by the cover 18 leaving a gap in a bottom portion thereof, when the mini nozzle 10 is disengaged from the floor nozzle 11, and thus the cross sectional area of the opening is reduced and thereby increasing the suction velocity. Since the opening is near the surface to be cleaned, the dust collection capacity is enhanced on the mini nozzle 10, enabling a greater range of vacuum cleaning. Moreover, if the end opening 16 is configured to be entirely closed by the cover 18, the suction capacity of the bottom suction inlet 15 can further be enhanced.

Figure 12A:
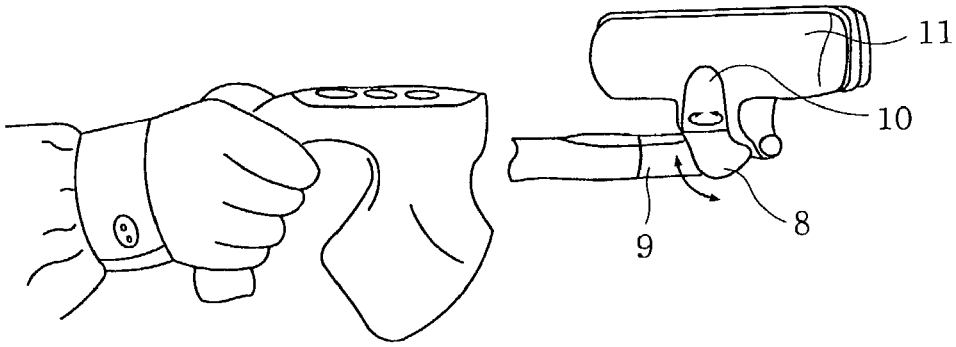
FIGS. 12A, 12B, and 12C illustrate the floor nozzle according to the positioning of a handle.
Figure 12B:
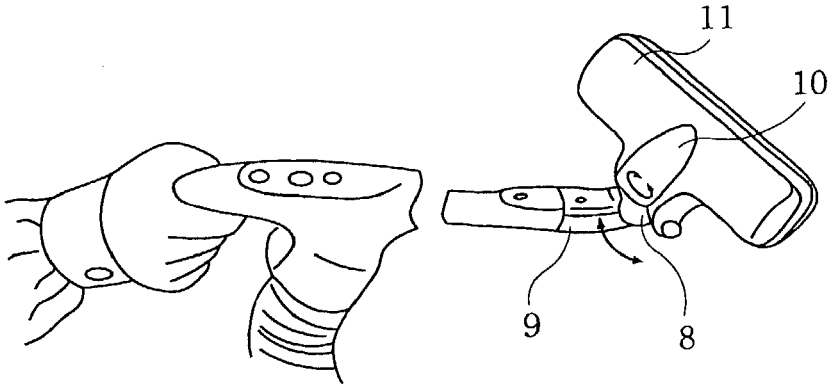
Figure 12C:
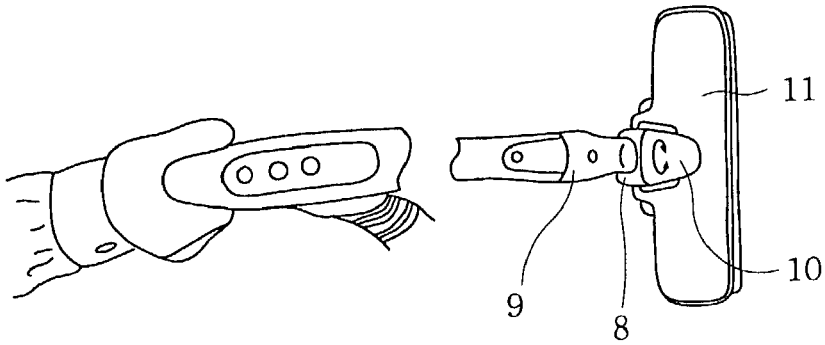

When the mini nozzle 10 is engaged with the floor nozzle 11, the mini nozzle 10 can be engaged in a vertical and horizontal motion by the rotatable joint 8 and the joint 9, and accordingly, the floor nozzle 11 can be rotated in any direction as illustrated in FIGS. 12A to 12C.

A joining portion of the suction head 40 and the rotatable joint 8 is horizontally rotatable with the mini nozzle 10, and thus as shown in FIG. 9, the entire suction inlet of the floor nozzle 11 can face the surface to be cleaned while coinciding with the direction of the end of the axis of the extension tube 2, thereby allowing a user to efficiently perform vacuum cleaning in a narrow space. And the mini nozzle 10 as described above is rotatably connected in a vertical and horizontal direction with a joining portion of the suction head 40, rotatable joint 8 and joint 9, and thus the joining portion between the suction inlet and the main body 1 is not rotatable, thereby improving airtightness thereof. Moreover, regardless of improving the airtightness, since the vertical and horizontal rotation takes place between the suction head 40 of the mini nozzle 10, the rotatable joint 8, and the joint 9, the controllability is not compromised.

Furthermore, a small radius wheel 36 is provided in a rear portion of the floor nozzle 11, where the rotation of the rotatable joint 8 of the mini nozzle 10 takes place, so to prevent a sliding or rising of the floor nozzle 11 about a small radius wheel 36 provided in a rear portion of the floor nozzle 11 when inserting the mini nozzle 10 into the floor nozzle 11 by the handle 4.

The configuration of the suction inlet 3 of the preferred embodiment may be applicable to a hand vacuum cleaner having a short suction path in a main body thereof having a handle thereon, and enhancing capacity thereof.

A second preferred embodiment in accordance with the present invention will now be described with reference to FIGS. 13 to 16. Parts that are substantially identical to those shown above will employ the same reference numerals and elaboration thereof will be omitted.

Figure 13:
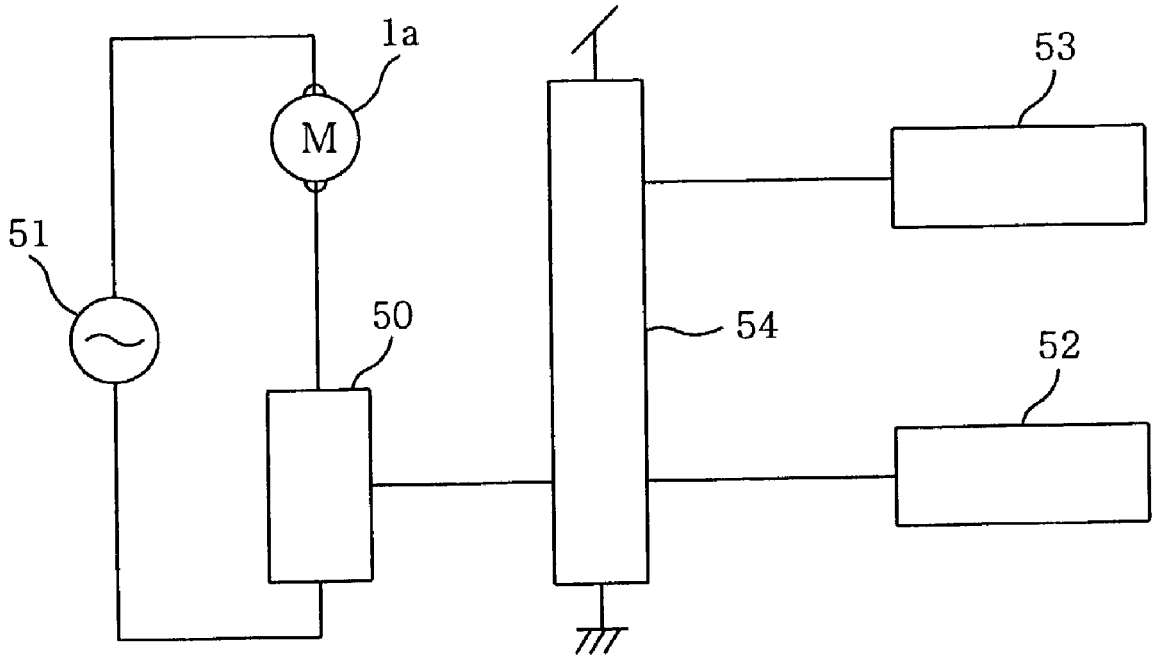
FIG. 13 is a block diagram illustrating an electrical connection of the electric vacuum cleaner of a second preferred embodiment in accordance with the present invention.

In referring to FIG. 13, reference numeral 50 arranged in series with AC 51, designates a means for operating an electric blower 1*a* included in a main body 7. A detecting means 52 is provided in the mini nozzle 10, which detects the connectivity between the floor nozzle 11 and the mini nozzle 10. In the first preferred embodiment, the floor nozzle 11 and the mini nozzle 10 are electrically connected via a pair of power feed contact points 17 provided in the mini nozzle 10 and a pair of receiving contact points 22 in the floor nozzle 11, however, in the second preferred embodiment, the configuration of the connection will be described below.

Moreover, a suction inlet 23 of a floor nozzle 11 has a greater opening area than a bottom suction inlet 15 and an end opening 15 of the mini nozzle 10. In addition, the electric vacuum cleaner of the second preferred embodiment is equipped with a rechargeable battery.

A reference numeral 53 is placed inside a handle 45 and is a means for selecting a level of power based on the condition of the surface to be cleaned, that is the user may select the level of suction, e.g., High, Mid, Low, Off, generated by the electric blower 1*a*. According to a user input, the control variables of the phase of the electric blower operation means 50 is determined. The reference numeral 54 determines the power supplied (control variables of the phase) to the electric blower 1*a* according to the detecting means 52 output and the user selected drive position of the power selecting means 53, thereby controlling the power supplied (control variables of the phase) to the electric blower 1*a*. The electric blower operating means 50 operates the electric blower 1*a* through the control means 54.

Figure 14:
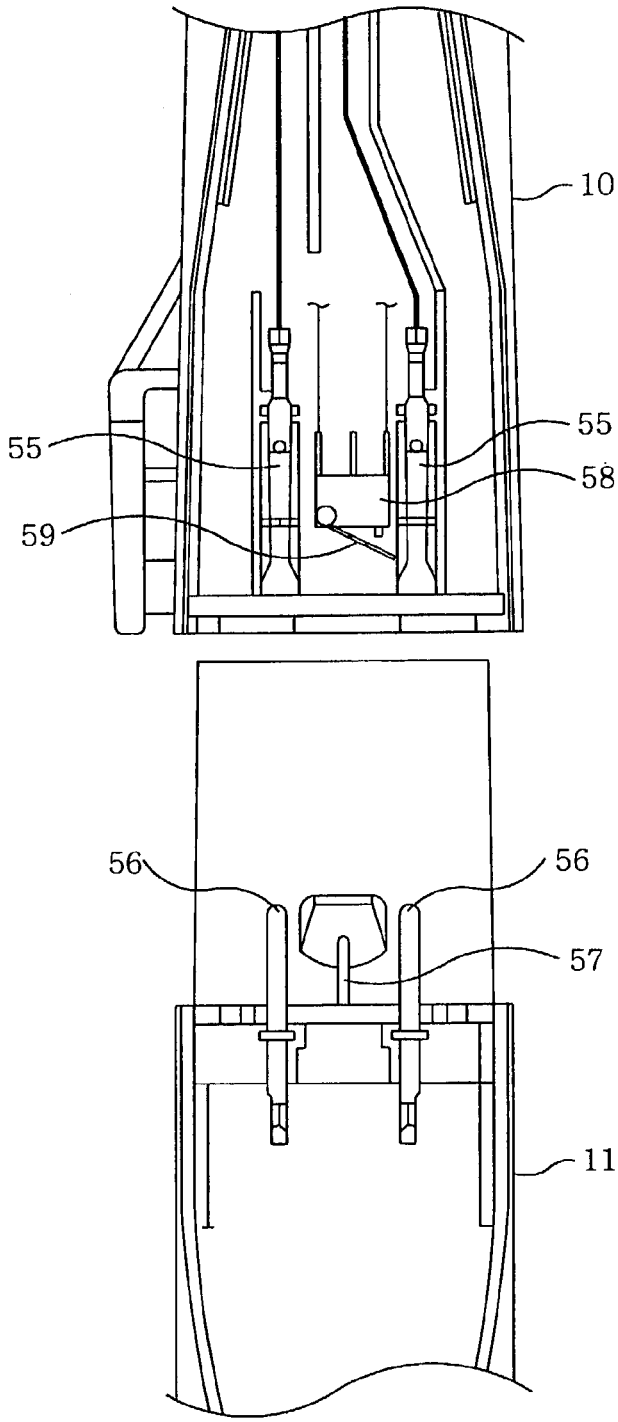
FIG. 14 presents a micro switch as a detection means.

FIG. 14 illustrates the connection between the floor nozzle 11 and the mini nozzle 10. Provided in a connection portion of the floor nozzle 11 is a connection pin 56 and a detection rib 57 to be electrically connected with a connection terminal 55 place on the mini nozzle 10. Moreover, as a means for detection 52 in the mini nozzle 10, in a position corresponding to detection rib 57 is a micro switch 58 equipped with a moving panel 59. Under such configuration, if the floor nozzle 11 is inserted to the mini nozzle 10 to be connected, the detection rib 57 presses the moving panel 59 of the micro switch 58 and turns the micro switch to ON position, thereby enabling the floor nozzle 11 to detect the connectivity thereof with the mini nozzle 10.

Figure 15:
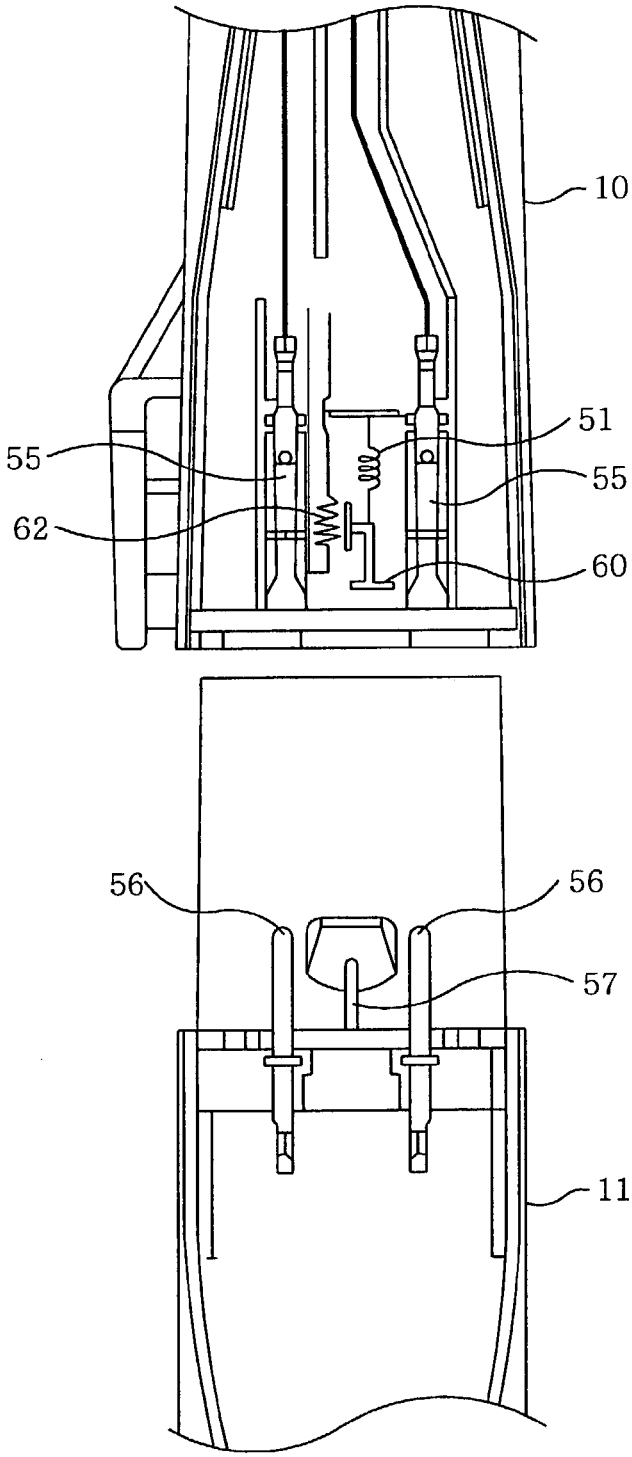
FIG. 15 depicts an electrical resistor as the detection means.

As illustrated in FIG. 15, similar to the floor nozzle 11, the mini nozzle 10 has a detection rib 57 and at a corresponding position thereof, having one end fixed and the other having a slide rib 60 varying electrical resistance connected with a resistor 62 having a spring 61. Under such configuration the detection rib 57 presses the slide rib 60, and varying the resistance of the resistor 62, thereby detecting the connectivity of the floor nozzle 11, as described above. Furthermore, in a case of unconnected floor nozzle 11, the spring 61 connected to the slide rib 60 and spring force thereby returns it to the original position. In place of the micro switch 58 and the electrical resistor 62, a capacitor (not illustrated) may be employed. Comparing the electric current in the capacitor while in connection and not in connection can provide information about connectivity thereof.

Figure 16:
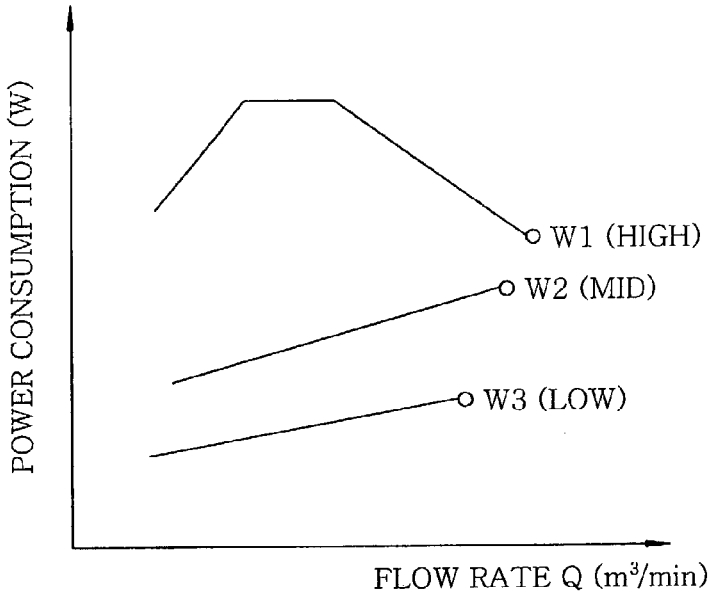
FIG. 16 represents a graph illustrating a relationship between power consumption and flow rate.

The operation based on the configuration described above is explained hereinafter. A user selects the power section means 53 to be on High, while the floor nozzle 11 is connected. As illustrated in FIG. 16, the electric blower 1*a* is controlled in order to obtain a power consumption level (control variable of the phase) of W1. In a similar manner, Mid was selected in order to obtain the power consumption rate of W2, and Low to obtain W3. According to a selection position of the power selection means 53, the control means 54 controls the electric blower 1*a* based on the pre-specified controlled variables of the phase, through the electric blower control means 50.

If the mini nozzle 10 is disengaged from the floor nozzle 11, the detection means 52 detects the disengaged status. According to the output of the detection means 52 the control means 54 adjusts the control variables of the phase, so that the power supplied W1 at the High position is at maximum in an upper limit of the power supply and allocates sufficient suction flow rate, to thereby enable an effective vacuum cleaning.

Figure 17:
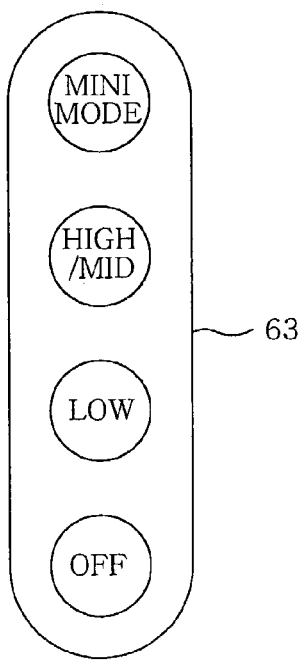
FIG. 17 sets forth a schematic diagram illustrating a power consumption setting switch of the electric vacuum cleaner of a third preferred embodiment in accordance with the present invention.

A third preferred embodiment in accordance with the present invention will be explained with reference to FIG. 17. Referring to FIG. 17, the power selection means 63 includes a mode selection switch and a mini mode switch. In a mode selection switch a user determines the setting, e.g., High, Mid, Low, Off, of the suction flow rate of an electric blower 1*a*, according to a condition of a surface to be cleaned. The mini mode switch for selecting the power of the electric blower 1*a* in order to maintain the performance of cleaning while using the mini nozzle 10. The setting on respective switches can be determined by the user, thereby adding greater convenience. Furthermore, the mini mode switch can be placed on a main body 7 of the electric vacuum cleaner.

Figure 18:
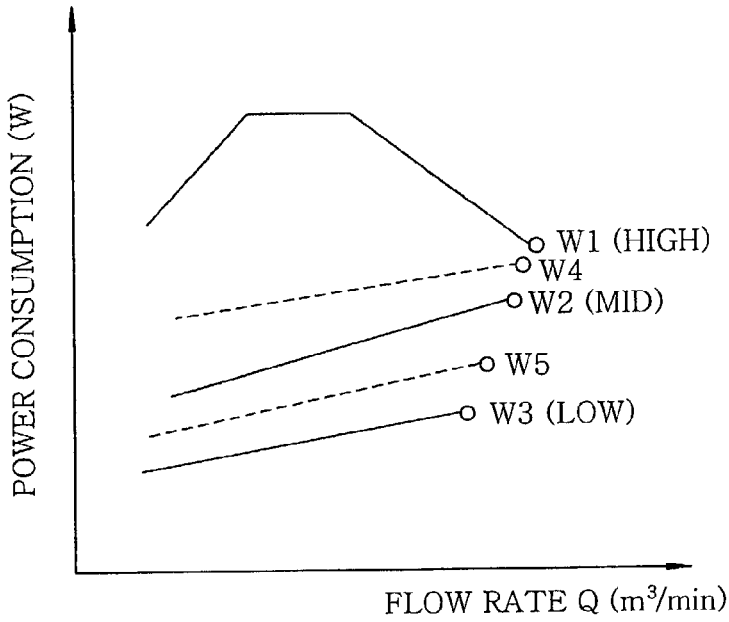
FIG. 18 represents a graph illustrating a relationship between power consumption and flow rate of a fourth preferred embodiment in accordance with the present invention.

A fourth preferred embodiment in accordance with the present invention will now be explained with reference to FIG. 18. If a detection means 52 placed in a mini nozzle 10 detects the mini nozzle 10 to be disengaged from the floor nozzle 11, the power setting of an electric blower 1*a* is established at High position and the power consumption W1 to be at maximum power and for Mid and Low positions, power consumptions are adjusted to W4 or W5, which are higher than the pre-specified drive setting power consumptions W2 or W3 by the control means 54, so that when mini nozzle 10 is disengaged from the floor nozzle, the power of the electric blower 1*a* is increased, so that a sufficient suction flow rate is allocated and maintained, thereby enabling an effective vacuum cleaning.

Figure 19:
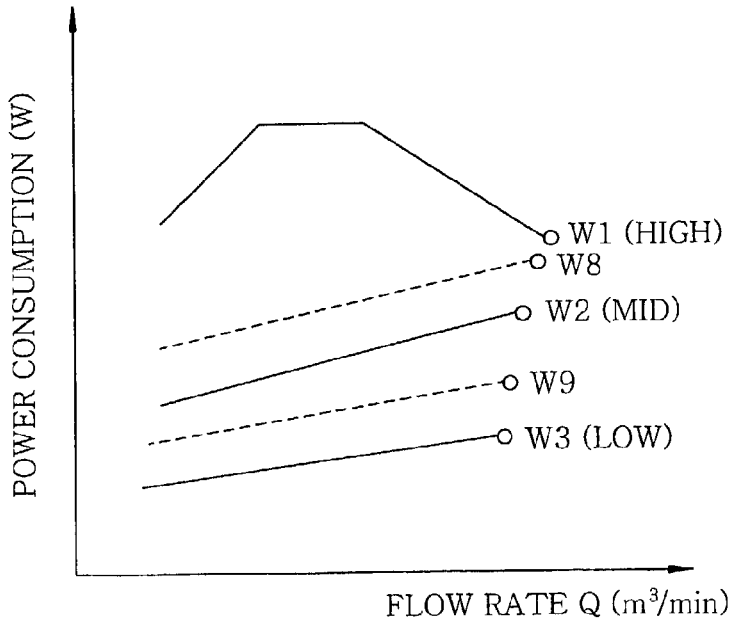
FIG. 19 represents a graph illustrating a relationship between power consumption and flow rate of a fifth preferred embodiment in accordance with the present invention.

A fifth preferred embodiment in accordance with the present invention is explained with reference to FIG. 19. If a detection means 52 placed in a mini nozzle 10 detects the mini nozzle 10 to be disengaged from the floor nozzle 11, the power setting of an electric blower 1*a* is established at Low position and the power consumption W3 to be at minimum power and for High and Mid positions, power consumptions are adjusted to W8 or W9, which are lower than the pre-specified drive setting power consumptions W1 or W2 by the control means 54, so that when mini nozzle 10 is disengaged from the floor nozzle, so that when the mini nozzle 10 is solely operated, the power of the electric blower 1*a* is reduced as to reduce power consumption and reduces noise associated therewith and maintain performance of the electric vacuum cleaner.

Figure 20:
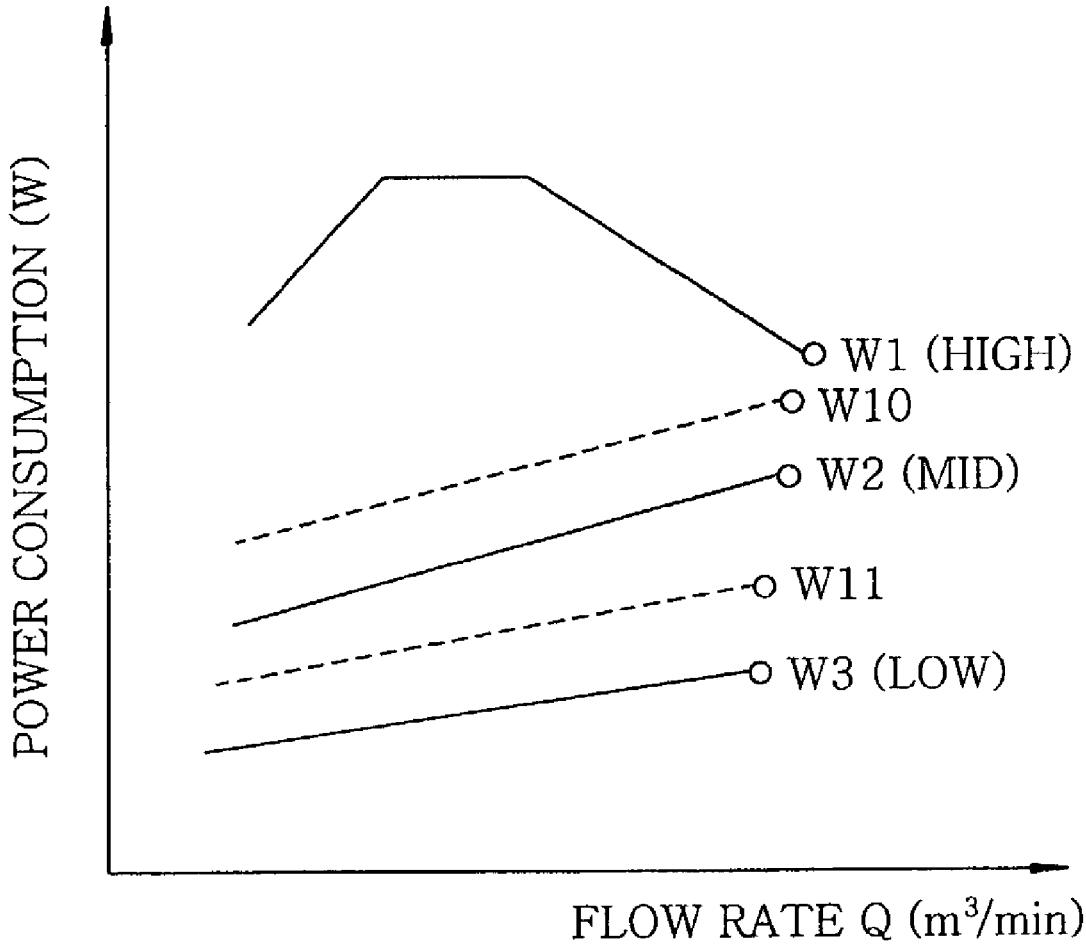
FIG. 20 represents a graph illustrating a relationship between power consumption and flow rate of a sixth preferred embodiment in accordance with the present invention.
Figure 21:
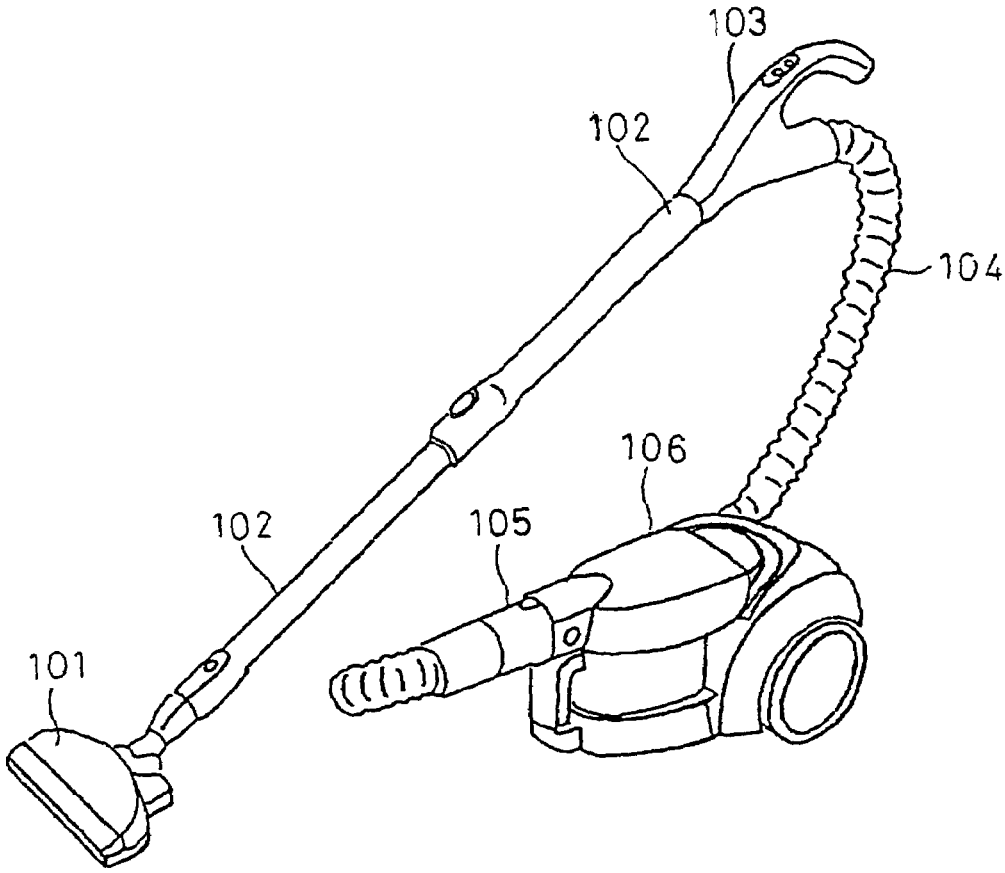
FIG. 21 (PRIOR ART)
FIG. 21 depicts a perspective view of a prior art vacuum cleaner.
Figure 22:
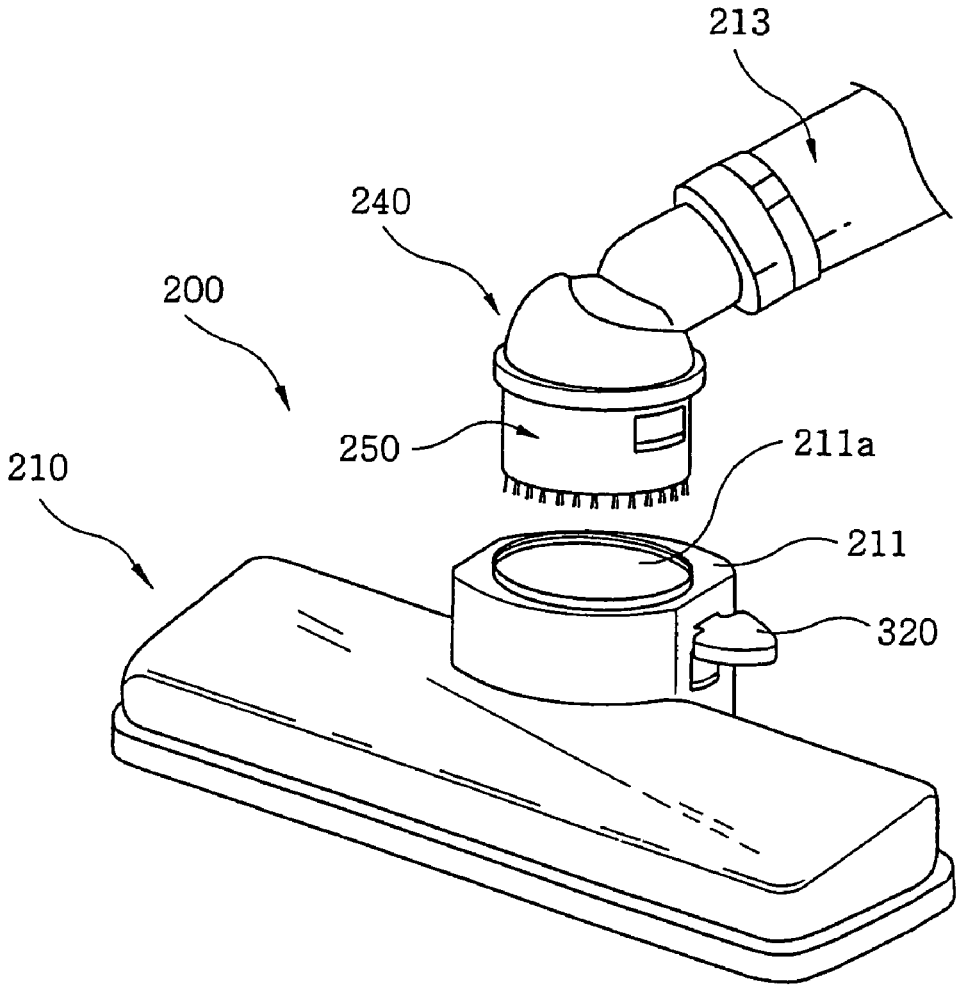
FIG. 22 (PRIOR ART)
FIG. 22 represents a perspective view of a suction nozzle of another prior art vacuum cleaner.

A sixth preferred embodiment in accordance with the present invention will now be explained with reference to FIG. 20. If a detection means 52 placed in a mini nozzle 10 detects the mini nozzle 10 to be disengaged from the floor nozzle 11 having a rotational brush, the power setting of an electric blower 1*a* is established at Low position and the power consumption W3 to be at minimum power and for High and Mid positions, power consumptions are adjusted to W10 or W11, which are lower than the pre-specified drive setting power consumptions W1 or W2 by the control means 54, so that when mini nozzle 10 is disengaged from the floor nozzle, the power of the electric blower 1*a* is increased, so that when the floor nozzle 11 equipped with the rotational brush is connected, the power of the electric blower 1*a* is reduced as to reduce power consumption and noise associated therewith and maintain performance of the electric vacuum cleaner.

While the invention has been shown and described with respect to the preferred embodiment, it will be understood to those skilled in the art that various changes and modifications may be made without departing from the spirit and scope of the invention as defined in the following claims.

What is claimed is:

1. A suction nozzle for use in an electric vacuum cleaner, comprising:

a floor nozzle;

a mini nozzle detachably secured to the floor nozzle, the mini nozzle including a suction head, a joint, and an extension tube; and a rotational locking member for locking motion of the joint of either the suction head and the joint or the joint and the extension tube when the mini nozzle is disengaged from the floor nozzle, wherein either the suction head and the joint or the joint and the extension tube is coupled allowing a vertical motion and the other is rotatably coupled, and wherein the suction head is unrotatably secured onto the floor nozzle while forming an air communication with the floor nozzle.

2. The suction nozzle of claim 1, wherein the mini nozzle has a suction opening forming an air communication with the floor nozzle on at least one of end portion or the bottom surface thereof.

3. The suction nozzle of claim 1, wherein a bottom surface of the mini nozzle is formed into a shape of nearly an arc, and a suction opening is formed on a side of the arc shaped surface.

4. The suction nozzle of claim 3, wherein on both sides of the suction opening, a cleaning member is provided thereon.

5. The suction nozzle of claim 1, further comprising a compartment, provided in the floor nozzle for holding the mini nozzle and a mechanism, provided in the compartment for engaging and disengaging the mini nozzle to and from the floor nozzle.

6. The suction nozzle of claim 5, further comprising a release lever for releasing the mini nozzle from the floor nozzle.

7. A suction nozzle for use in an electric vacuum cleaner, comprising:

a floor nozzle; and a mini nozzle detachably secured to the floor nozzle, the mini nozzle including a suction head, a joint, and an extension tube, wherein either the suction head and the joint or the joint and the extension tube is coupled allowing a vertical motion and the other is rotatably coupled, wherein the suction head is unrotatably secured onto the floor nozzle while forming an air communication with the floor nozzle, and wherein an end portion and a bottom surface of the mini nozzle are respectively provided with a suction opening, at least one of the suction openings forming an air communication with the floor nozzle, and the suction opening of the end portion being closed while the mini nozzle is disengaged from the floor nozzle.

8. A suction nozzle for use in an electric vacuum cleaner, comprising:

a floor nozzle; and a mini nozzle detachably secured to the floor nozzle, the mini nozzle including a suction head, a joint, and an extension tube, wherein either the suction head and the joint or the joint and the extension tube is coupled allowing a vertical motion and the other is rotatably coupled, wherein the suction head is unrotatably secured onto the floor nozzle while forming an air communication with the floor nozzle, and wherein the floor nozzle includes a rotational brush run by a motor and a power receiving contact point from the motor, and at a position on the mini nozzle corresponding thereto, a power feeding contact point electrically connected with a main body of the vacuum cleaner is provided.

9. A suction nozzle for use in an electric vacuum cleaner, comprising:

a floor nozzle having an elongated suction inlet and a drive portion protruding from approximately the center of the elongated suction inlet toward the rear;

a mini nozzle detachably secured to the floor nozzle, the mini nozzle including a suction head, a joint, and an extension tube; and a rotational locking member for locking motion of the joint of either the suction head and the joint or the joint and the extension tube when the mini nozzle is disengaged from the floor nozzle, wherein the mini nozzle long in the longitudinal direction is detachably aligned with a recess provided along the suction inlet and the drive portion of the floor nozzle, while forming an air communication with the floor nozzle.

10. The suction nozzle of claim 9, wherein either the suction head and the joint or the joint and the extension tube is coupled allowing a vertical motion and the other is rotatably coupled, and the suction head is detachably aligned with the recess.

11. The suction nozzle of claim 9, wherein the mini nozzle has a suction opening forming an air communication with the floor nozzle on at least one of end portion or the bottom surface thereof.

12. The suction nozzle of claim 9, wherein a bottom surface of the mini nozzle is formed into a shape of nearly an arc, and a suction opening is formed on a side of the arc shaped surface.

13. The suction nozzle of claim 12, wherein on both sides of the suction opening, a cleaning member is provided thereon.

14. The suction nozzle of claim 9, further comprising a compartment, provided in the floor nozzle for holding the mini nozzle and a mechanism, provided in the compartment for engaging and disengaging the mini nozzle to and from the floor nozzle.

15. The suction nozzle of claim 14, further comprising a release lever for releasing the mini nozzle from the floor nozzle.

16. A suction nozzle for use in an electric vacuum cleaner, comprising:

a floor nozzle having an elongated suction inlet and a drive portion protruding from approximately the center of the elongated suction inlet toward the rear; and a mini nozzle detachably secured to the floor nozzle, wherein the mini nozzle long in the longitudinal direction is detachably aligned with a recess provided along the suction inlet and the drive portion of the floor nozzle, while forming an air communication with the floor nozzle, and wherein an end portion and a bottom surface of the mini nozzle are respectively provided with a suction opening, at least one of the suction openings forming an air communication with the floor nozzle, and the suction opening of the end portion being closed while the mini nozzle is disengaged from the floor nozzle.

17. A suction nozzle for use in an electric vacuum cleaner, comprising:

a floor nozzle having an elongated suction inlet and a drive portion protruding from approximately the center of the elongated suction inlet toward the rear; and a mini nozzle detachably secured to the floor nozzle, wherein the mini nozzle long in the longitudinal direction is detachably aligned with a recess provided along the suction inlet and the drive portion of the floor nozzle, while forming an air communication with the floor nozzle, and wherein the floor nozzle includes a rotational brush run by a motor and a power receiving contact point from the motor, and at a position on the mini nozzle corresponding thereto, a power feeding contact point electrically connected with a main body of the vacuum cleaner is provided.

18. An electric vacuum cleaner, comprising:

an electric blower for creating a suction;

a floor nozzle communicated with the electric blower, for suctioning dirt on a surface to be cleaned;

a mini nozzle detachably secured on the floor nozzle for suctioning dirt on the surface to be cleaned;

a sensing means for detecting whether or not the mini nozzle is engaged in the floor nozzle; and a control means for controlling the power consumption of the electric blower, wherein the control means controls the power consumption of the electric blower according to the output of the sensing means.

19. The vacuum cleaner of claim 18, wherein when the mini nozzle is disengaged from the floor nozzle, the power consumption of the electric blower is raised by the control means.

20. The vacuum cleaner of claim 18, wherein when the mini nozzle is disengaged from the floor nozzle, the power consumption of the electric blower is reduced by the control means.

21. The vacuum cleaner of claim 18, wherein the floor nozzle includes a rotational brush for sweeping dirt on the surface to be cleaned and a motor for providing rotation to the brush, and wherein when the mini nozzle is disengaged from the floor nozzle, the rotational brush is stopped.

22. A suction nozzle for use in an electric vacuum cleaner, comprising:

a floor nozzle having an elongated suction inlet; and a mini nozzle detachably secured to the floor nozzle, the mini nozzle including an elongated suction head, a joint, and an extension tube, wherein when secured to the floor nozzle, a length direction of the suction head is substantially parallel to a bottom surface of the mini nozzle and substantially normal to a length direction of the suction inlet of the floor nozzle, and the joint is disposed at a rear side of the mini nozzle, wherein the joint couples the extension tube to the suction head, while allowing the extension tube to make a vertical motion against the suction head, and the suction head is unrotatably secured onto the floor nozzle while forming an air communication with the floor nozzle.

* * * * *